US006167771B1

(12) United States Patent
Kumar et al.

(10) Patent No.: US 6,167,771 B1
(45) Date of Patent: Jan. 2, 2001

(54) CLEARANCE DISTRIBUTION TO REDUCE THE LEAKAGE AREA

(75) Inventors: Keshava B. Kumar, South Windsor, CT (US); James W. Bush, Skaneateles, NY (US)

(73) Assignee: Carrier Corporation, Syracuse, NY (US)

( * ) Notice: Under 35 U.S.C. 154(b), the term of this patent shall be extended for 0 days.

(21) Appl. No.: 09/208,866

(22) Filed: Dec. 10, 1998

(51) Int. Cl.[7] ..... F16H 55/17; F16H 55/22
(52) U.S. Cl. ..... 74/458
(58) Field of Search ..... 74/458, 462, 424.7; 418/201.3

(56) References Cited

U.S. PATENT DOCUMENTS 4,671,751 * 6/1987 Kasuya et al. ..... 418/201
4,673,344 * 6/1987 Ingalis ..... 418/201
5,044,906 * 9/1991 Tsuboi ..... 418/201
5,947,713 * 9/1999 Ohman et al. ..... 418/201

* cited by examiner

*Primary Examiner*—Thomas R. Hannon
*Assistant Examiner*—Colby Hansen

(57) ABSTRACT

Zero clearance screw rotor profiles are modified by determining clearance requirements at spaced points on the profiles and varying the clearance distribution between adjacent points using a non-linear distribution. Additionally, when the clearances are put in the rotors, zero clearance is maintained between the rotors in the contact band which is maintained near the pitch circle.

7 Claims, 3 Drawing Sheets

CLEARANCE DISTRIBUTION TO REDUCE THE LEAKAGE AREA

BACKGROUND OF THE INVENTION

The profile design of a conjugate pair of screw rotors starts with zero clearance profiles which satisfy all conjugacy requirements and do not have any gap between the male and female rotors at any conjugate point. The design is then modified to include a clearance resulting in clearance profiles. The modifications are in the direction normal to the rotor profile at any given point and can vary from point-to-point.

The need to provide a clearance is the result of a number of factors including: thermal growth of the rotors as a result of gas being heated in the compression process; deflection of the rotors due to pressure loading resulting from the compression process; tolerances in the support bearing structure and machining tolerances on the rotors which may sometimes tend to locate the rotors too close to one another which can lead to interference; and machining tolerances on the rotor profiles themselves which can also lead to interference. Superimposed upon these factors is the existence of pressure and thermal gradients as the pressure and temperature increase in going from suction to discharge.

To accommodate these factors, the zero clearance profile coordinates are modified before manufacturing the rotors. If zero clearance profiles are manufactured and put in an operating compressor, it will result in interference between the rotors due to some or all of the foregoing reasons, causing excessive wear and high bearing loads, if the compressor can even operate at all. Clearance profiles introduce leakage as the price of reducing wear and bearing loads since a zero clearance profile has no leakage area through the seal line of the mesh zone of the rotors. The leakage through the clearance area of the seal line will flow directly from the compression chamber back to the compressor suction and thus tends to be a more severe leak than, for example, leakage across the tip clearance or through the blow hole, both of which tend to be between successive compression chambers.

SUMMARY OF THE INVENTION

In providing a clearance profile according to the teachings of the present invention, a number of factors are initially considered. As to thermal growth, it is estimated based upon the size and material of the rotors and the design operating temperature of the compressor. The associated clearances should be such that when maximum expected thermal growth occurs, there is no unwanted interference between the rotors. As to deflection, it is a function of the loading and stiffness characteristics of the rotors and of the support bearing structure. The pressure loading on the rotors is determined from the operating characteristics of the compressor application. Stiffness characteristics of the rotors are determined from their size and material as well as the supporting mechanism. The associated clearances are selected such that there is no unwanted contact at maximum deflections. Finally, the associated clearances of the rotors are determined by the capabilities of the respective manufacturing processes for the rotors, supporting mechanism, and locating features. The associated clearances are selected such that there is no unwanted contact at maximum tolerance deviations. All of these various factors are considered in determining the total amount of clearance to be introduced between the rotors. As a result the typically maximum clearance requirements can be determined for selected key points. At the same time, there are other key zones, such as the contact band and the backlash zone, where either zero or minimum clearance is desired. The typically minimum clearance requirements can be determined for these selected key points.

Knowing the clearance requirements, the next step according to the teachings of the present invention is to achieve a reduced leakage area while still having required clearances to produce functional screw rotor profiles.

Selecting two points on the zero clearance rotors such as a point at or near the tip and a point at or near the root of the rotor, the clearance requirement for functional screw rotor profiles at these points can be determined based on the requirements of manufacturing tolerances, deflection, thermal growth, etc.

There are certain sections of the rotor, such as the contact band, where zero clearance is maintained between the rotors. The segment of the rotor defining the contact band is the region where the required torque is transmitted between the rotors. These segments are positioned near the pitch circles of the rotors which is the location of equal rotational speed on the rotors resulting in rolling contact and thereby in less wear. As contact starts to move away from the pitch circle there is more sliding contact rather than pure rolling contact which would result in more wear if the contact band were to be located away from the pitch circle.

There are other sections of the rotor, such as the backlash zone, where a controlled clearance is maintained after allowing for the effects of tolerances, deflections, etc. The backlash zone is positioned near the pitch circle on the opposite side of the screw rotor lobes from the contact zone. The controlled clearance of the backlash zone prevents too tight of a fit between the two rotors which might otherwise cause binding and wear while at the same time limiting the space available for the rotors to rattle or impact each other through the backlash clearance which might otherwise result in objectionable noise and/or vibration.

Together, the four zones, namely the rotor tip, the root, the contact band and the backlash zone, constitute portions where a specific, well-defined clearance or clearance range is established separately for each portion. Conventionally there would be a linear distribution of the clearance between these positions. A quadradic, cubic or higher order distribution can be used to vary the clearances while reducing the leakage area defined by the clearances since such distributions initially reduce the clearances more rapidly than a linear distribution, leaving smaller clearances over the rest of the profile between the two points. It should be noted that distribution of clearance should be smooth to accommodate manufacturing processes with no steps allowed.

It is an object of this invention to provide functional screw rotor profiles with reduced leakage areas.

It is another object of this invention to reduce compressor noise/vibration.

It is a further object of this invention to more sharply define the contact band.

It is an additional object of this invention to provide clearance distribution such that the contact band is close to the pitch circle with sufficiently large clearances away from the contact band such that no sliding takes place even when tolerances and deflections are considered. These objects, and others as will become apparent hereinafter, are accomplished by the present invention.

Basically, zero clearance screw rotor profiles are modified by determining clearance requirements at spaced points on the profiles and varying the clearance distribution between adjacent points using a non-linear distribution. Additionally, when the clearances are put in the rotors, zero clearance is maintained between the rotors in the contact band which is maintained near the pitch circle.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
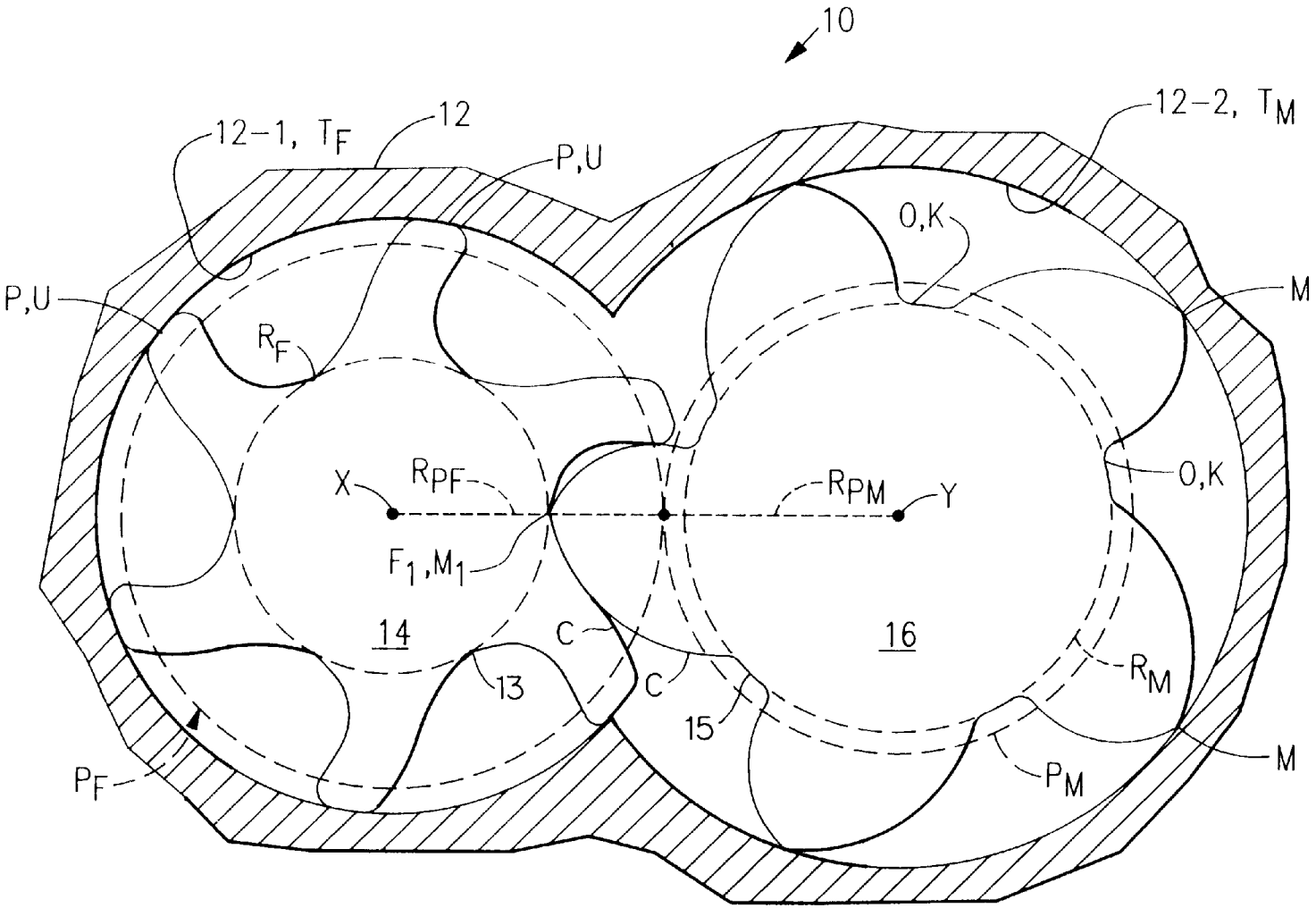
FIG. 1 illustrates a rotor pair as seen in a transverse or radial plane.

In FIG. 1, the numeral 10 generally indicates a screw machine such as a screw compressor. Screw machine 10 has a casing 12 with overlapping bores 12-1 and 12-2 located therein. Female rotor 14 has a pitch circle, $P_F$, and is located in bore 12-1. Male rotor 16 has a pitch circle, $P_M$, and is located in bore 12-2. The axes indicated by points X and Y are perpendicular to the plane of FIG. 1 and are parallel to each other and are separated by a distance equal to the sum of the radius, $R_{PF}$, of the pitch circle, $P_F$, of female rotor 14 and the radius, $R_{PM}$, of the pitch circle, $P_M$, of male rotor 16. The axis indicated by point X is the axis of rotation of female rotor 14 and the center of bore 12-1 whose diameter generally corresponds to the diameter of the tip circle, $T_F$, of female rotor 14. Similarly, the axis indicated by point Y is the axis of corresponds to the diameter of the tip circle, $T_M$, of male rotor 16.

As illustrated, female rotor 14 has six tips, represented by co-located points P and U, separated by six intervening grooves, the bases of which are represented by points R, while male rotor 16 has five lands, represented by points M, separated by five grooves, the bases of which are represented by co-located points O and K. Accordingly, the rotational speed of rotor 16 will be 6/5 or 120% of that of rotor 14. When the rotors are thus rotated, the velocity of any two points on the respective pitch circles are the same and the rotors are said to rotate at the same pitch circle velocity. Either the female rotor 14 or the male rotor 16 may be connected to a prime mover (not illustrated) and serve as the driving rotor. Other combinations of the number of female and male lands and grooves may also be used.

Figure 2:
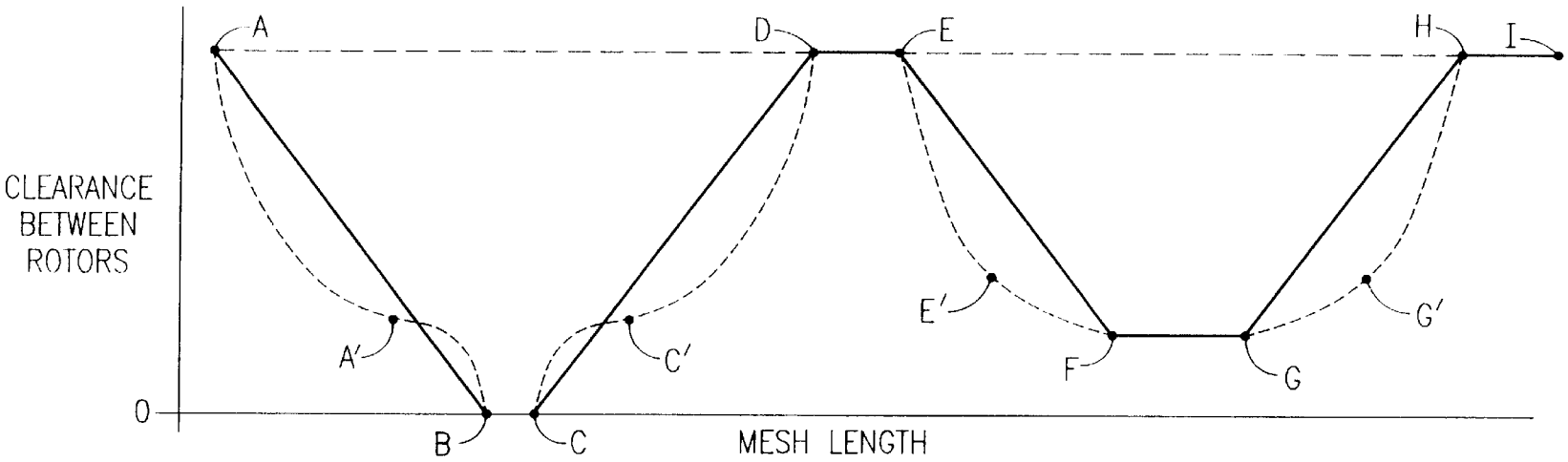
FIG. 2 is a plot of the gap or clearance between the rotors vs. the mesh or seal length.
Figure 3:
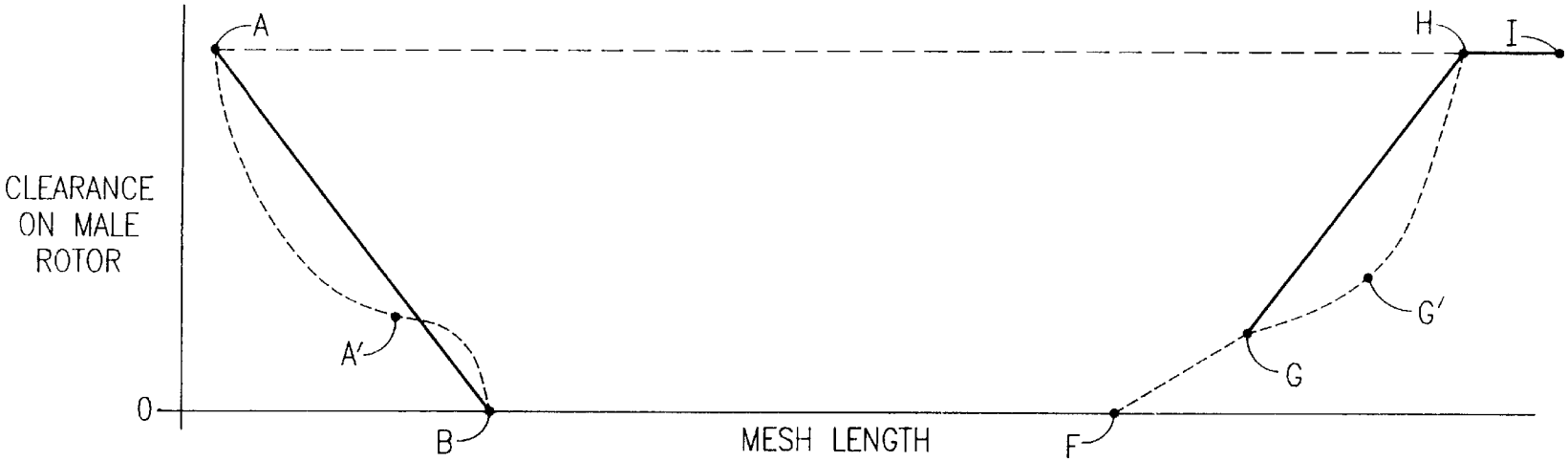
FIG. 3 corresponds to the portion of FIG. 2 representing the clearance values on the male rotor.
Figure 4:
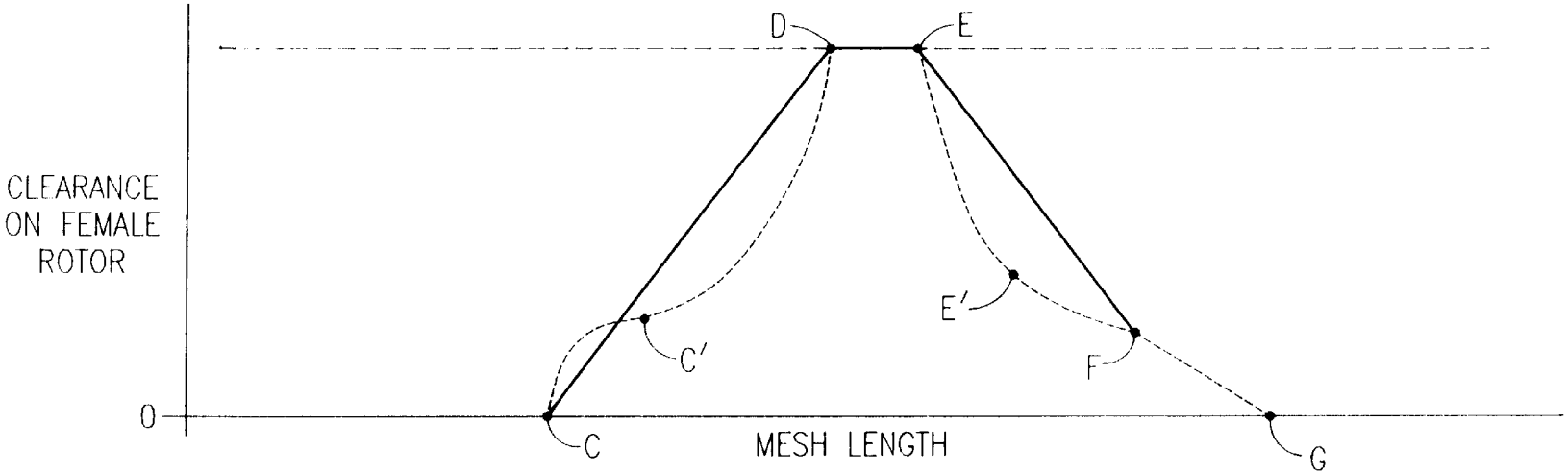
FIG. 4 corresponds to the portion of FIG. 2 representing the clearance values on the female rotor.

In FIGS. 2–4 the solid line A-B-C-D-E-F-G-H-I, or its segments, represents the PRIOR ART clearance between an assembled pair of conjugate rotors extending from a point, A, on one lobe to a corresponding point, I, on an adjacent lobe. In FIG. 2, the clearance represented by the area under the solid line A-B-C-D-E-F-G-H-I, represents the leakage area. It will be noted that the PRIOR ART plot is a series of straight lines and is reflective of a linear distribution of clearances. A portion, B-C, of the plot is on the zero clearance line and represents the contact band represented on FIG. 1 as C where zero clearance is desired. A second portion, F-G, of the plot is generally of a uniform clearance and represents the backlash zone which is the area of driving contact upon powered reverse rotation or of intermittent contact in a rattling or chatter situation. Where reverse rotation is the result of pressure equalization, as at shut down, contact remains with the contact band.

The dashed lines A-A'-B, C-C'-D, E-E'-F, and G-G'-H, in FIG. 2 represent the modified clearance distribution resulting from the application of the teachings of the present invention. It is clear that the dashed lines represent a reduction in the leakage area which will correspond to an increase in compressor efficiency. It should be noted that the present invention provides an alternative clearance distribution between points common with the PRIOR ART and that the contact band B-C, male tip/female root D-E, backlash zone F-G, and female tip/male root H-I are nominally the same for the PRIOR ART and the present invention.

Figure 6:
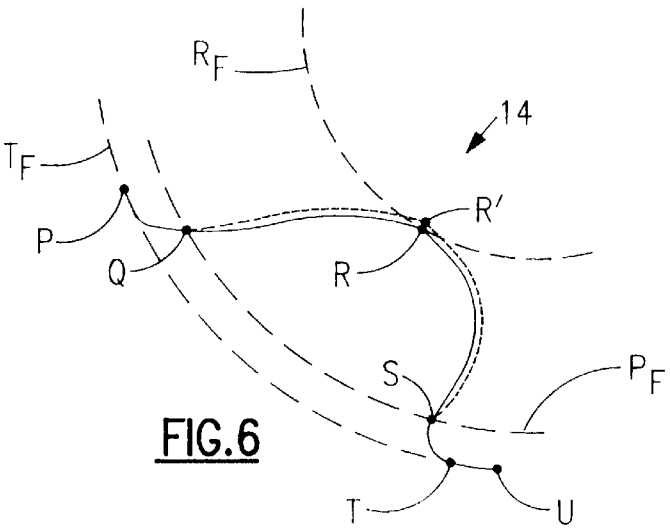
FIG. 6 illustrates the modification of the female rotor.
Figure 5:
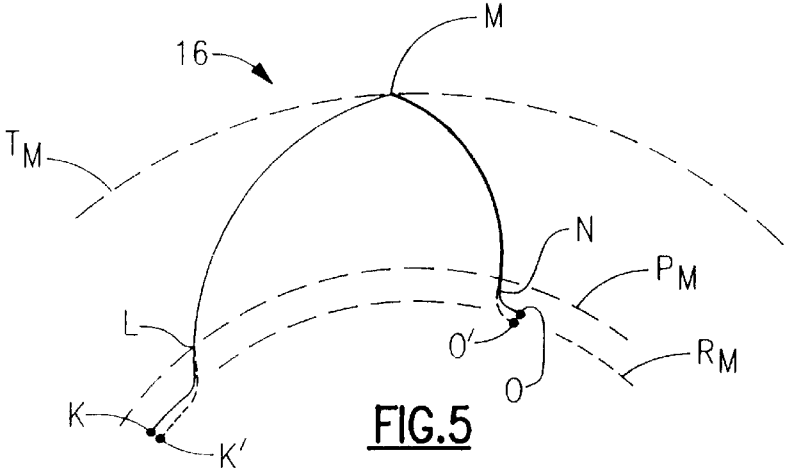
FIG. 5 illustrates the modification of the male rotor.

As noted, FIG. 2 illustrates the clearance distribution between the two rotors. It should be noted that the horizontal axis of FIGS. 2–4 represents the linear distance along the lobe or rotor profile, i.e. as if you held each end and "pulled it out straight". While the clearances are located on both rotors, the clearance between the rotors may be removed from a single rotor for segments of the clearance. FIGS. 3 and 4 show the portion of the clearance in FIG. 2 provided by the male and female rotors, respectively. FIGS. 5 and 6 illustrate the modification to the zero clearance profiles to achieve the clearances of FIGS. 3 and 4, respectively. Specifically, in FIG. 5, the solid profile K-L-M-N-O, represents the zero clearance profile of the male rotor. The dashed segments K'-L and N-O' represent the clearance profile modifications to the male rotor according to the teachings of the present invention and corresponding to dashed segments A-A'-B and G-G'-H, respectively, of FIG. 3. Similarly, in FIG. 6, the solid profile P-Q-R-S-T represents the zero clearance profile of the female rotor. The dashed segment Q-R'-S represents the clearance profile modifications to the female rotor according to the teachings of the present invention.

Referring specifically to FIG. 2, the screw rotor clearance distribution starts with specifying the clearance at four key zones, namely: (1) the male tip/female root represented by D-E; (2) the backlash zone represented by F-G; (3) the female tip/male root represented by H-I; and (4) the contact band B-C which always has a zero clearance. Upon examining FIG. 2, it will be noted that the clearance at the four key zones is the same for the PRIOR ART profile and in the profile of the present invention. Defining the clearances includes specifying the boundaries as you go along the profile. The end or boundary points of the specified clearance portions, as defined in FIG. 2, represent fixed points that must be connected. For the PRIOR ART clearances, a linear distribution was assigned between the end points defined by the specified clearances, i.e. a straight line was drawn between adjacent points in FIG. 2.

According to the teachings of the present invention, curves are used in place of straight lines to connect the areas of specified clearances. These curves can be quadratic curves, cubic curves, sinusoids, or some other high order curve. Specific guidelines or rules for selecting these curves and their characteristics include:

First, near the tips/roots, where clearances are highest, the curve should "fall away" rapidly at first, as in the nature of a catenary, so that the clearance decreases rapidly to avoid having wide zones near the tips/roots with similarly high clearances. The rate of decrease will be more rapid or steep than for a linear distribution.

Second, the curve should begin to level out at some clearance value which is reasonably controllable in manufacturing as in the vicinity of points A' and C' in FIG. 2. Stated otherwise, its value will be influenced most heavily by manufacturing tolerances. Defining the "degree of steepness" as being characterized by the angle between a radial line through a point on the surface and the surface with smaller values of the angle being "steeper" and defining "flatness" as being characterized by the degree of perpendicularity of the surface to a radial line through a point on the surface with more perpendicular surfaces being "shallower", where the slope of the lobe surface is relatively steep, rotor deflections will result in relatively small changes in operating clearances as compared to the flat tip and root regions. Accordingly, deflections and thermal effects are less important in the relatively steep portions of the lobe surface. The rate of clearance decrease in this area will become more gradual than for a linear distribution. This is clearly shown in FIG. 2 when comparing the solid and dotted lines in the regions of points A' and C' where the dotted lines approach being parallel with the horizontal axis.

Third, as the curve A'-B approaches the contact band B-C, the clearance should decrease again, changing rapidly by the time it intersects the contact band B-C, as clearly shown in FIG. 2. This causes the contact band B-C to be sharply defined.

While this is somewhat of an aid in inspection, more importantly it prevents incidental contact away from contact band B-C. With linear distributions, where the clearance changes less rapidly at the contact band B-C, normal manufacturing tolerances can cause regions near the contact band B-C to sometimes be at the same level, or higher, and thus to also have contact. Since sliding velocities are higher here, higher wear potential results.

Fourth, this property of the clearance curves A-A'-B and C-C'-D between the tip/root and contact band B-C results in an S-shape, more complex than the conventional straight line or even a quadratic curve. This S-shape may be formed of two different quadrates or of a single curve of higher order.

Fifth, as the curve approaches the backlash zone F-G, smaller clearances which change more slowly are acceptable and dashed lines E-E'-F and G-G'-H approach being parallel with F-G relative to the horizontal axis. Contact in the backlash zone F-G is intermittent and, when it does occur, is not heavily loaded, unlike the contact band B-C. In this case a simple quadratic curve, or equivalent, is acceptable and, by extending the length where the clearance curve is at a lower value with a shallow slope, serves to help minimize clearance area and thus leakage. Note the dashed line segments F-G in FIGS. 3 and 4 taken together show that all of the clearance at point F is on the female rotor and all of the clearance at point G is on the male rotor with a linear distribution in the region therebetween.

Sixth, the ultimate objective is to achieve the total clearance distribution throughout the total engagement. At any given point or segment, clearance may be built into either the male rotor 16 or the female rotor 14 lobe geometry. Zero clearance profiles are usually designed with integral tip and root circle diameters, e.g. 90.0 mm and 104.0 mm. With reference to FIGS. 5 and 6, the male tip circle is $T_M$, the male pitch circle is $P_M$, the male root circle is $R_M$, female tip circle is $T_F$, the female pitch circle is $P_F$, and the female root circle is $R_F$. The diameters of tip circles $T_M$ and $T_F$, are more easily controlled and inspected and their nominal value is the basis for sizing the rotor bore diameters and bearing bore alignment specifications. It is thus more convenient to maintain the diameters of tip circles $T_M$ and $T_F$, as designed, and to introduce clearances at the rotor roots as defined by root circles $R_M$ and $R_F$. For this reason, and as illustrated in FIGS. 3 and 4,clearance zones are usually divided between male and female rotors such that the added clearance is at the root of the respective rotors, i.e. inside male pitch circle $P_M$, and female pitch circle $P_F$ Accordingly, the tips of rotors 16 and 14, outside their respective pitch circles $P_M$ and $P_F$, generally remain the original zero clearance profiles.

Turning now to FIG. 5, it will be noted that the clearance profiles defined by dashed lines K'-L and N-O' lie entirely within male pitch circle $P_M$ and that L-M-N is of a zero clearance profile. Similarly in FIG. 6, it will be noted that the clearance profile defined by dashed line Q-R'-S lies entirely within female pitch circle $P_F$ and that solid lines P-Q and S-T-U are the zero clearance profile.

Although a preferred embodiment of the present invention has been illustrated and described, other changes will occur to those skilled in the art. It is therefore intended that the scope of the present invention is to be limited only by the scope of the appended claims.

What is claimed is:

1. A conjugate pair of intermeshing rotors comprising:

each of said rotors having a plurality of lobes including helical crests and intervening grooves and adapted for rotation about parallel axes within a working space of a screw rotor machine;

each of said rotors having a tip circle, a pitch circle, and a root circle;

one rotor of said pair of rotors being a female rotor formed such that the major portion of each of said lobes of said female rotor is located inside said pitch circle of said female rotor;

the other rotor of said pair of rotors being a male rotor formed such that the major portion of each of said lobes of said male rotor is located outside said pitch circle of said male rotor;

said crests of each one of said pair of rotors following said grooves of the other one of said pair of rotors to form a continuous sealing line between said pair of rotors;

said rotors being in driving engagement with each other through a contact band located at least close to said pitch circle of each of said pair of rotors;

said rotors rotating at a constant pitch circle velocity;

a running clearance between said pair of rotors characterized by clearances between conjugate mating points on said pair of rotors at their points of closest approach as said rotors rotate at a constant pitch circle velocity, said running clearance being located between a pair of mating segments on said rotors extending from a point at least close to said pitch circle of one of said pair of rotors to a point closer to said tip circle of said one rotor and from a point at least close to said pitch circle of the other one of said pair of rotors to a point closer to the root circle of said other rotor;

said running clearance, as measured along the lobe surfaces in a radial plane, is variable;

said running clearance being greater where said mating segments are closer to the respective tip and root circles and smaller where said mating segments are closer to the respective pitch circles;

and said variability being characterized by changing more rapidly where said mating segments are closer to the respective tip and root circles and by changing less rapidly where said mating segments are closer to the respective pitch circles whereby leakage is reduced.

2. A pair of intermeshing rotors as claimed in claim 1 in which said mating segments extend between said contact band and said male tip circle and said female root circle (C'–D).

3. A pair of intermeshing rotors as claimed in claim 2 in which said running clearance varies so as to have an "S" shape whereby said running clearance changes more rapidly near said contact band (C) in a small pair of mating segment sections (C–C') which connects between said mating segments (C'–D) and said contact band (C) and less rapidly near said mating segments (near and at C') in said mating segment sections.

4. A pair of intermeshing rotors as claimed in claim 1 in which said mating segments extend between said contact band and said male root circle and said female tip circle (A'–A).

5. A pair of intermeshing rotors as claimed in claim 4 in which said running clearance varies so as to have an "S" shape whereby said running clearance changes more rapidly near said contact band (B) in a small pair of mating segment sections (A'–B) which connects between said mating segments (A'–A) and said contact band (B) and less rapidly near said mating segments (near and at A') in said mating segment sections.

6. A pair of intermeshing rotors as claimed in claim 1 in which said mating segments extend between said pitch circle on the respective lobe surfaces opposite said contact band and said male tip circle and said female root circle (E–F).

7. A pair of intermeshing rotors as claimed in claim 1 in which said mating segments extend between said pitch circle on the respective lobe surfaces opposite said contact band and said male root circle and said female tip circle (G–H).

* * * * *